US005187462A

United States Patent [19]

Montean

[11] Patent Number: 5,187,462

[45] Date of Patent: Feb. 16, 1993

[54] MULTIPLE MAGNET ASSEMBLY FOR USE WITH ELECTROMAGNETIC ARTICLE SURVEILLANCE MARKERS

[75] Inventor: Samuel Montean, Blaine, Minn.

[73] Assignee: Minnesota Mining and Manufacturing Company, Saint Paul, Minn.

[21] Appl. No.: 480,253

[22] Filed: Feb. 15, 1990

[51] Int. Cl.[5] ..... H01F 13/00

[52] U.S. Cl. ..... 335/284; 335/306; 340/572

[58] Field of Search ..... 335/284, 306; 340/551, 340/572

[56] References Cited

U.S. PATENT DOCUMENTS 3,609,611 9/1971 Parnell ..... 335/284
4,684,930 8/1987 Minasy et al. ..... 335/284
4,689,590 8/1987 Heltemes ..... 340/572 X
4,752,758 6/1988 Heltemes ..... 335/284
4,968,972 11/1990 Canipe ..... 340/551

*Primary Examiner*—George Harris
*Attorney, Agent, or Firm*—Gary L. Griswold; Walter N. Kirn; William B. Barte

[57] ABSTRACT

A multiple magnet assembly for magnetizing a magnetizable element of a desensitizable electromagnetic article surveillance marker, in which each successive assembly provides at a working surface a magnetic field of the same polarity but decreasing intensity. Any demagnetization effect attributable to reverse or back fields associated with one assembly are overcome by magnetization produced by a subsequent assembly, thus allowing markers having magnetizable elements with significantly different coercivee forces to be magnetized by the same apparatus.

5 Claims, 1 Drawing Sheet

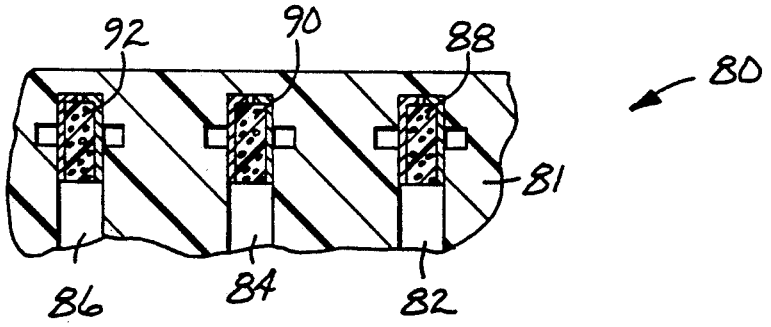
Fig. 4
Fig. 1
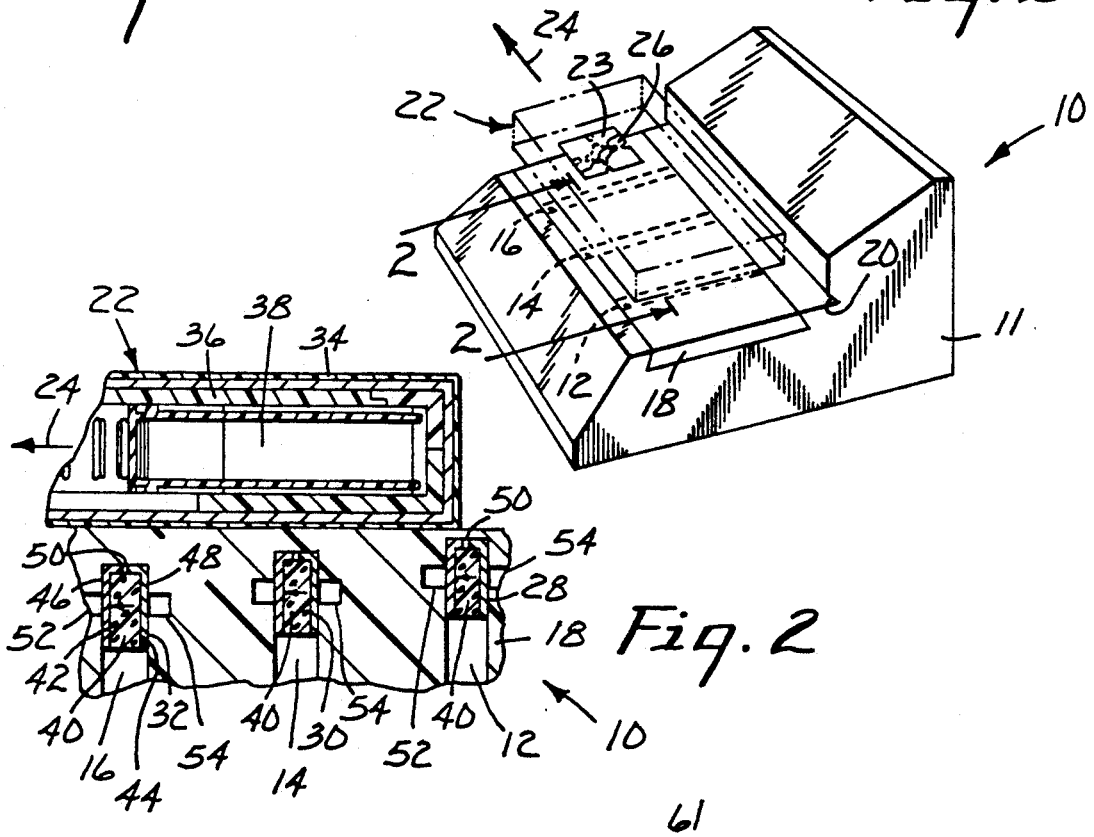
Fig. 2
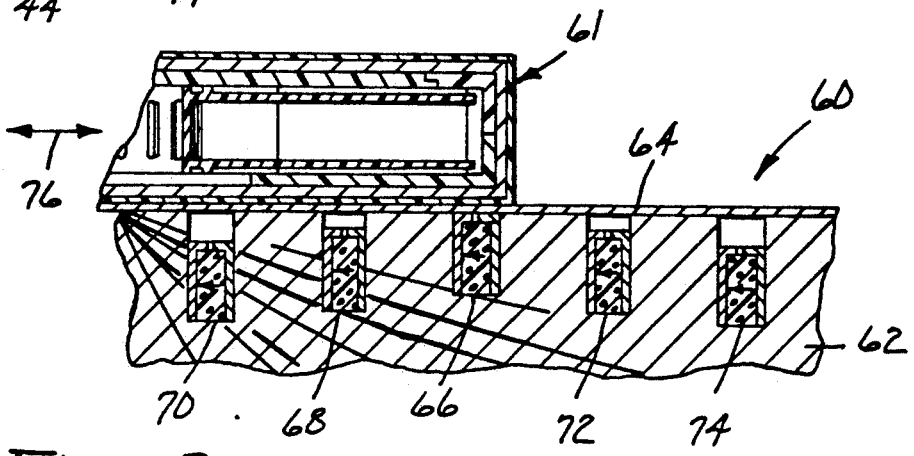
Fig. 3

MULTIPLE MAGNET ASSEMBLY FOR USE WITH ELECTROMAGNETIC ARTICLE SURVEILLANCE MARKERS

FIELD OF THE INVENTION

This invention relates to electromagnetic article surveillance (EAS) systems of the type in which an alternating magnetic field is applied within an interrogation zone and the presence of a high-permeability, low coercive force ferromagnetic marker within the zone is detected based on signals produced by the marker in response to the applied field. In particular, the present invention relates to such systems in which the marker includes both a high-permeability, low coercive force portion and at least one magnetizable section having a higher coercive force, and which when magnetized alters the detectable signal otherwise produced, and is directed to an apparatus for magnetizing the higher coercive force section of such markers.

BACKGROUND OF THE INVENTION

EAS systems of the type described above, are, for example, disclosed and claimed in U.S. Pat. No. 3,665,449 (Elder and Wright). As set forth at Col. 5, lines 10 to 39 therein, the high-coercive force section of a marker may be magnetized by placing it in the field of a large permanent magnet of sufficient intensity, and gradually removing the field, such as by withdrawing the marker therefrom.

While such a technique may be useful in many areas and with the markers affixed to a wide variety of articles, the magnetic fields associated therewith have been found to unacceptably interfere with magnetic states associated with certain articles. For example, the compact size and popularity of prerecorded magnetic audio and video cassettes make such articles frequent targets for shoplifters, and hence likely articles with which anti-theft markers would be used. At the same time however, such affixed markers would be desirably desensitized upon purchase, and it has been found that certain prior art desensitizer apparatus such as described above may unacceptably affect signals prerecorded on magnetic tapes within the cassettes.

To avoid such deleterious effects on prerecorded magnetically sensitive articles, it is also known to provide apparatus in which a steady-state field is produced which rapidly decreases in intensity only a short, controlled distance from the apparatus. Thus, such an apparatus, while being capable of magnetizing high-coercive force sections of a marker brought close thereto, would be incapable of interfering with the magnetic signals recorded on tapes within a cassette to which the marker is affixed. See U.S. Pat. No. 4,499,444 (Heltemes and Montean). The apparatus there described comprises a permanent magnet assembly which includes at least one section of a permanent magnet ferromagnetic material having two substantially opposed major surfaces and a pair of pole pieces each of which is proximate to and extends over a major portion of the major surfaces and terminates proximate to the other pole piece, leaving a gap therebetween of substantially constant width extending along the length of the permanent magnet material. The permanent magnet material is substantially uniformly magnetized to present one magnetic polarity at one of the major surfaces and the opposite polarity on the other major surface. The pole pieces in turn concentrate external magnetic lines of flux resulting from the magnetized material near the gap. The resultant external magnetic field decreases rapidly with increasing distance from the gap, and enables a marker to be moved relative to the gap to magnetize the section of said high coercive force material within the marker while not altering magnetic states such as may exist within an article to which the marker is secured.

An apparatus such as described in the aforementioned U.S. Pat. No. 444 has generally been found to be satisfactory so long as it is used with markers of a single type, and whose magnetizable components all have a coercive force within a given range, such that the field intensity at the working surface of the apparatus is controlled to appropriately magnetize those components while not adversely affecting magnetically sensitive articles. Conversely, it has been found that when the apparatus is used with markers nominally of the same type, but in which the value of the coercive force varies over a relatively wide range of allowed values, certain conditions may cause unsatisfactory results.

For example, to prevent adverse effects on magnetically sensitive articles with which the markers are desirably used, the field intensity at some distance from the working surface of the apparatus at which such magnetically sensitive articles are to be located, must be below certain design limits. However, a practical apparatus desirably has an effective operable range extending a short distance above the surface within which all allowed materials must become magnetized. Some materials having coercive forces near the highest allowed value and positioned near the outer edge of the allowed range, i.e., in the weakest fields, may not become sufficiently magnetized. And, since there is typically a reverse directed back field, which is particularly strong near the surface of the apparatus, such back fields may be sufficient to reduce the magnetization state in materials near the surface and having coercive forces near the lowest allowed value. Such reduced magnetization levels could, in turn, inadequately bias the low coercive, high permeability material of the marker, such that the response of the marker would be inadequately altered. Such effects are further compounded and totally unacceptable results may occur, if markers of significantly different types, each having magnetizable materials having coercive forces in significantly different ranges are used with the same apparatus.

SUMMARY OF THE INVENTION

In contrast to apparatus containing a single, permanent magnet assembly as described in the aforementioned U.S. Pat. No. 4,499,444, the apparatus of the present invention comprises a housing having a plurality of recesses within each of which one such permanent magnet assembly is positioned. The intensity at the working surface above each recess is varied such that a highest intensity field is produced at the working surface above one of the assemblies and progressively weaker fields of the same polarity are produced at the surface above assemblies to one side of the first assembly. Accordingly, a marker secured to an article moved along the working surface from a location over the first recess toward locations over the remaining recesses is successively exposed to fields of the same polarity and progressively lower intensity, causing a magnetizable component of the marker to become magnetized. Reverse demagnetization effects caused by reverse polarity back fields of a preceding assembly are thus overcome by the forward polarity fields of subsequent assemblies, such that the magnetizable components become fully magnetized.

BRIEF DESCRIPTION OF THE DRAWINGS

FIG. 1 is a perspective view of one embodiment of the apparatus of the present invention utilizing three permanent magnet assemblies.

FIG. 2 is a partial cross sectional view of the embodiment of FIG. 1 along the lines 2—2; and FIG. 3 is a partial cross sectional view of another embodiment in which five permanent magnet assemblies are provided.

FIG. 4 is a partial cross sectional view of another embodiment in which all permanent magnet assemblies are positioned the same distance below the surface of the housing.

DETAILED DESCRIPTION

Permanent magnet assemblies such as those described in the aforementioned U.S. Pat. No. 4,499,444 are designed to concentrate magnetic flux across a gap defined by specially configured pole pieces. While most of the flux may flow across the gap, there may also be an appreciable fringe, or back field having an opposite polarity to that across the gap. Even at a relatively short distance above the gap, such as at the working surface of the apparatus described above, such a back field may have an intensity of several percent of the forward flux flowing across the gap. In constructions like that shown in the referenced patent, at short distances above the gap, the back field may exceed 6% of the field directly over the gap.

Desensitizable markers with which the present apparatus is designed to work may have magnetizable elements in a range of coercive forces. For example, the apparatus may be desirably designed to operate with three distinct types of markers, all having at least one responder section of a high permeability, low coercive force material such as permalloy and at least one magnetizable section. One such marker, has a magnetizable element with a coercive force in the range of 24,000–28,000 A/m (300 to 350 oersteds), a second type has a magnetizable element with a coercive force in the range of 14,400–18,400 A/m (180 to 230 oersteds), and a third type has a magnetizable element with a coercive force in the range of 4,800–7,200 A/m (60–90 oersteds). Such markers may, for example, be type QT Quadratag TM, Type WH-0117 Whispertape TM and type QT/N Quadratag TM markers, respectively, all of which are sold by Minnesota Mining and Manufacturing Company (3M).

It has been generally observed that a field of about 1.5 times the coercive force to reliably magnetize such magnetizable materials, while oppositely directed field intensities of about 0.5 times the coercive force may appreciably lower the residual magnetization. Thus, field intensities of about 1.5 times the coercive force are required to magnetize such elements at the maximum distance from the working surface at which a marker would reasonably be expected to be. Based on normal field attenuation, the field right at the working surface would be appreciably higher, e.g., about twice the coercive force. And, a back field 6% that of the primary field would then be about 12% of the coercive force. Thus, a forward field of sufficient intensity to magnetize elements having a maximum coercive force of about 28,000 A/m (350 oersteds) would have a back field of about 3360 A/m (42 oersteds). Such an oppositely directed back field could then adversely affect, e.g., partially demagnetize, a magnetizable element having a coercive force of less than 8000 A/m (100 oersteds).

The problem is accentuated when highly anisotropic magnetizable elements are used in markers. For example, such an anisotropic material, having a nominal coercive force of about 25,600 A/m (320 oersteds) is used in the type QT Quadratag markers discussed above. Since the alignment of the marker when used in the apparatus is uncontrolled, intensities of 48,000–64,000 A/m (600–800 oersteds) are necessary to reliably magnetize such materials. Such intensities at the working surface of the apparatus may correspond to an intensity of about 96,000 A/m (1200 oersteds). And such a front field could have an associated back field of about 6400 A/m (80 oersteds), which is sufficient to adversely affect the magnetization of magnetizable elements having a coercive force less than about 14,400 A/m (180 oersteds), such as markers of the second and third types identified above.

The apparatus of the present invention which employs a plurality of magnetic assemblies, each presenting a successively weaker field at the working surface, overcomes such adverse affects in that each successively weaker forward field is sufficiently intense to restore the magnetization in an element partially demagnetized by the back field of a preceding assembly.

As shown in FIG. 1, a preferred embodiment of the apparatus of the present invention may be in the form of a desk mounted apparatus 10 having a housing 11 and concealed within three recesses, or cavities 12, 14 and 16, three magnet assemblies as described hereafter. The cavities 12, 14, and 16 are in turn covered to protect the magnet assembly and also to provide a wear surface over which articles having desensitizable markers affixed thereto may be passed during the use of the apparatus. For example, an insert 18 formed of a machinable plastic such as Delrin TM, an acetal resin sold by E. I. DuPont DeNemours & Company may be milled from the bottom side to provide the respective recesses, leaving the top surface uninterrupted to form the wear surface. Such a surface resists scratching or chipping as may otherwise occur with cover plates having a painted surface and thereby remains aesthetically acceptable even over many cycles of use.

The configuration shown in FIG. 1 is further preferably provided with a triangular recess 20 which extends along the working surface and assists in maintaining bulky articles to which a marker may be affixed in contact with the working surface of the insert 18, so that the fields provided by the magnet assemblies within the recesses 12, 14 and 16 will be able to magnetize the high coercive force portions of the marker. Such an article 22 could, for example, be a jacketed video cassette having a desensitizable marker 23 containing a magnetizable portion 26 affixed on one surface of the jacket.

While the apparatus 10 may be used with the working surface established by the insert 18 in a horizontal position, such that the article 22 may be moved across the horizontal surface, the apparatus may also be positioned to have the working surface vertical. More bulky articles may then be moved in from one side. (Field intensities referred to herein as being above the gap presuppose a horizontally positioned surface.)

The housing 11 of the apparatus 10, as shown in FIG. 1, is preferably constructed of non-magnetic materials, and may be fabricated from appropriately dimensioned and finished hardwood within which is fitted the machined insert 18. Bevelled faces may be provided in the housing 11 to carry appropriate legends, manufacturer identification, instructions and the like.

In using the apparatus of FIG. 1, it will be recognized that the article 22 is to be moved in the direction shown by arrow 24, thus causing a desensitizable marker 23 affixed to one surface to be moved so that the marker 23 is passed over the magnet assemblies within cavities 12, 14 and 16. Thus, for example, if the article 22 is a typically packaged video cassette, the marker 23 could be affixed to one side of the box provided for cassette storage and the box held so as to be positioned on the insert 18 and passed therealong.

The details of Example 1 of the magnet assemblies are shown in the cross sectional view of FIG. 2. As may there be seen, the housing 11 of the apparatus 10 is shown to have three recesses 12, 14, and 16 within which respective magnet assemblies 28, 30 and 32 are positioned.

As further shown in FIG. 2, the article 22 may include an outer enclosure 34, such as a storage box, within which is a prerecorded video cassette 36. The cassette is further shown to include a reel of magnetic tape 38.

As shown in FIG. 2, one embodiment of the respective magnet assemblies 28, 30 and 32 comprises a section of a permanent magnet material 40 which is magnetized so as to have one magnetic polarity extending along a first major surface 42 and the opposite magnetic polarity extending along the surface 44. Each assembly further includes a pair of pole pieces 46 and 48 respectively, which members are formed of magnetically "soft" steel and are configured to extend around the material 40 and to thereby define a gap 50 within which the external magnetic field provided by the element 40 are concentrated. In this and subsequent examples, the section(s) of permanent magnetic material were cut from a flexible magnet material, type B1013 "Plastiform" sold by 3M Co., St. Paul, Minnesota, magnetized conventionally. In particular, the assemblies 28, 30 and 32 were formed of sections of such a magnet material approximately 0.125 inch (0.317 cm) wide and approximately 0.25 inch (0.635 cm) high, extending lengthwise into the drawing a distance of approximately 3.375 inches (8.6 cm). The gaps 50 were approximately 0.025 inches (0.635 mm) wide. Each of the pole pieces, 46 and 48 respectively, which define the gaps were formed of a soft silicon steel, i.e., isotropic type M-19. The gaps 50 were further maintained by including therein a small rectangular section of a non-magnetic material (aluminum) having the dimensions of the gap, while extending the entire length of the pole pieces, i.e., 3.375 inches (8.6 cm) long.

Alternative constructions for the magnet assemblies are set forth in FIGS. 3-5 of the afore-referenced U.S. Pat. No. 4,499,444, where they may be seen to use more than one piece of permanently magnetized material, different configurations of soft-steel flux return members and pole pieces, etc.

In an embodiment in which the insert 18 is formed of an injection molded plastic such as Delrin TM, which material is not readily bonded by conventional adhesives, it may be preferable to include in the respective recesses additional channels 52 and 54 within which an adhesive may become physically anchored to thereby firmly secure a respective magnet assembly in place.

In a preferred embodiment of the apparatus as shown in FIG. 1 and 2 in which the construction is as described hereinabove, the three respective assemblies 28, 30 and 32 were positioned below the working surface distances of 0.007 inches (0.18 mm), 0.080 inches (2.0 mm) and 0.150 inches (3.8 mm) respectively. Accordingly, field intensities within an operating window extending from the operating surface to 0.025 inches (0.64 mm) over the surface were as follows: Over the first assembly 28, the intensities ranged from approximately 144,000 A/m (1800 oersteds) down to approximately 60,000 A/m (750 oersteds). The wide variations in fields within this range is again exemplary of the rapid decrease in the field intensity above the gap caused by the pole pieces. The field intensities over the second assembly, spaced 0.080 inches (0.18 mm) below the working surface created fields ranging from 24,100 A/m (310 oersteds) down to about 20,000 A/m (250 oersteds), while that above the third assembly, located 0.150 inches (3.8 mm) below the working surface, exhibited fields ranging from about 12,800 A/m (160 oersteds) to 9600 A/m (120 oersteds).

Such intensities relate to specific markers with which the apparatus is desirably utilized in the following manner. As noted, the field within the operating window above the first assembly will range from about 144,000 A/m (1800 oersteds) at the working surface to about 60,000 A/m (750 oersteds) at the top of the operating window. Assuming a back field of approximately 6%, such field intensities would range from about 3600 to 8640 A/m (45 to 108 oersteds). Accordingly, if a first type marker utilizing magnetizable material of gamma $Fe_2O_3$ particles having a coercive force of about 25,600 A/m (320 oersteds) was exposed to such fields, the forward field intensity would be appropriate to magnetize the material, and the back field would be insufficient to adversely affect the magnetization. Such a marker would thus be appropriately magnetized, and neither the most intense back fields of the first magnet assembly, nor the fields of the subsequent magnet assemblies would have any affect thereafter.

If a second type marker having a magnetizable material of about 16,000 A/m (200 oersteds) were exposed to the three assemblies, it would again be recognized that the front field intensity of the first assembly would be more than sufficient to magnetize such a material. However in this case a reverse field of about 8000 A/m (100 oersteds) could adversely affect the magnetization state of such material, as that intensity would be within approximately one-half that of the coercive force of such material. Similarly, if a third type marker having a coercive force in the range of 4800 to 7200 A/m (60 to 90 oersteds) were exposed to the first assembly, the forward field would also be more than adequate to fully magnetize such material. Moreover, the reverse field of 8000 A/m (100 oersteds) could easily reduce that magnetization to near zero, if not possibly provide a slight negative magnetic state.

The effect of the second magnetic assembly on such markers must then be considered. As the first type marker having a coercive force of about 25,600 A/m (320 oersteds) is exposed to the fields provided by the second magnetic assembly, the forward field will have substantially no effect, as the material will still be fully magnetized. And, the reverse field of about 1200 to 1500 A/m (15 to 19 oersteds) will be insufficient to adversely affect that magnetic state. A second marker having a magnetizable material with a coercive force of about 16000 A/m (200 oersteds), when exposed to the forward field intensities of about 20,000 to 25,000 A/m (250 to 310 oersteds) could have its magnetization restored, if possibly adversely affected by the reverse fields of the first assembly, and the reverse field of the second assembly in the range of 1200 to 1500 A/m (15 to 19 oersteds) would be expected to have little if any effect. Finally, when a third marker having a coercive force in the range of 4800 to 7200 A/m (60 to 90 oersteds) is exposed to the forward fields, remagnetization of any demagnetized material as might occur due to the reverse field intensity of about 100 Oersteds from the first magnetic assembly will definitely occur, thereby causing such a marker to be fully magnetized. The reverse fields of only 1200–1500 A/m (15 to 19 oersteds) would be expected to have very little, if any effect on such a marker.

Finally, when three such markers are exposed to the fields above the third assembly, wherein the forward field intensity would range from about 9600 to 12,800 A/m (120 to 160 oersteds) and the reverse field would range from about 560–800 A/m (7 to 10 oersteds), no effect on either the first type marker, having a coercive force of 25,600 A/m (320 oersteds), nor the second type marker having a coercive force about 16,000 A/m (200 oersteds), would occur. However, the third type marker, having a coercive force in the range of 4800 to 7200 A/m (60 to 90 oersteds) would become fully magnetized by the forward field, thereby restoring any decreased magnetization caused by the reverse fields of the second magnetic assembly. Similarly, the reverse field of less than about 800 A/m (10 oersteds) would be insufficient to have any negative affect on the magnetizable element of such third markers.

It will thus be recognized that the use of the multiple magnet assemblies as described in FIGS. 1 and 2 is desirable when a variety of markers having magnetizable materials with different ranges of coercive forces are utilized.

As noted above, in the construction shown in FIGS. 1 and 2, it is necessary that the markers be moved along the direction of the arrow 24 so as to successively expose the markers to fields of gradually decreasing intensity. In another embodiment shown in cross sectional view of FIG. 3, an apparatus 60 is provided in which an article 61 may be moved along the apparatus in either direction. Thus the apparatus 60 includes a housing 62 such as may be formed of wood or the like in the same manner as described in the aforementioned U.S. Pat. No. 4,499,444 and having a thin 0.010 inch (0.25 mm) non-magnetic metal plate 64 defining the working surface. Within the housing 62 are provided five recesses within which five magnetic assemblies 66, 68, 70, 72 and 74 are positioned, each of the assemblies being positioned at varying distances below the working surface. Thus to provide forward fields of maximum intensity, the assembly 66 is positioned within a cavity such that the gap of that assembly is directly below the top metal layer. In a similar manner, the assemblies 68 and 72 on either side of the first assembly 66 are positioned within cavities such that the top surface of each of the respective assemblies is 0.080 inches (2.0 mm) below the top surface of the metal layer. In like fashion, the outermost assemblies 70 and 74 are positioned within cavities such that the top of the gaps of the respective assemblies are approximately 0.150 inches (3.8 mm) below the top of the metal layer 64.

In operation, such an assembly will function substantially like that described hereinabove, however as the article 61 is moved in either direction along the double-headed arrow 76, a marker secured to the article will be exposed to gradually decreasing fields.

In lieu of a series of magnet assemblies of each of the same intensity, positioned at different distances from the surface, as described above, a further embodiment is shown in FIG. 4 in which the apparatus 80 comprises a housing 82 containing a series of magnet assemblies, each having a progressively weaker field intensity proximate the respective gaps, and wherein each assembly is positioned within a recess the same distance from the surface. As there shown, the housing 82 of the assembly 80 includes three recesses 82, 84, and 86, within each is positioned a magnet assembly 88, 90, 92 respectively.

In the embodiments set forth above, apparatus utilizing either three or five permanent magnet assemblies have been shown, such assemblies being particularly desired when three types of markers are to be used with the apparatus, each type of marker utilizing a magnetizable element having an appreciably different coercive force. In other situations where only two such different types of markers are intended to be used, similar apparatus wherein only two of the magnet assemblies are employed will be appropriate.

It will thus be seen that a variety of embodiments and alternative configurations of the apparatus of the present invention may be readily constructed by one skilled in the art. Thus, for example, a further embodiment of the apparatus of the present invention could be constructed as a hand-held device, as opposed to the table mounted configurations shown in the FIGS. 1 through 3. In such an embodiment an apparatus would typically include handle and head portions respectively such that within the head portion would be positioned a plurality of magnet assemblies, each of which would be positioned at varying distances from the working surface. Also, the magnet assemblies may be constructed using a variety of types of permanent magnets both cast, ceramic and flexible bonded varieties. Likewise a variety of pole piece configurations may also be used. And, different magnet constructions may be employed in which pole tips of opposite polarity define a gap without the need for separate pole pieces. It may further be recognized that the length of the gap provided by the various configurations is substantially unlimited, being limited only by the length of the permanent magnet member and the pole pieces provided for use therewith. The intensity of the fields at the working surface may be controlled not only by varying the distance of an assembly from the surface, but also by varying the gap length, the reluctance of the material between the gap and the working surface, etc.

The apparatus according the present invention may be constructed having variable width gaps, enabling it to be used with articles of many different sizes and articles wherein the antipilferage markers are secured at various locations, such that the markers and/or the articles need not be accurately positioned with respect to the apparatus.

In the above embodiments, markers have been described for use in which the magnetizable element is magnetized by the apparatus of the present invention. In a typical environment, the electronic article surveillance (EAS) systems with which such markers are to be used operate in a mode in which the magnetization of the magnetizable elements causes the response of the marker to be altered such that the marker is recognized by the system as being in a desensitized state. Accordingly, the apparatus of the present invention may be regarded as a desensitization apparatus. It is similarly within the scope of the present invention that it be used with other systems in which the magnetization of the element is recognized by the associated EAS system as causing the marker to be in a sensitized state. The apparatus of the present invention would then be regarded as a resensitization apparatus. 4:1.9

I claim:

1. An apparatus adapted for use with an electronic article surveillance system for magnetizing a magnetizable component of a desensitizable marker secured to an article to thereby alter the detectability of the marker, said apparatus comprising a plurality of spaced apart permanent magnet assemblies, each including at least one section of ferromagnetic material and two parallel pole tips of opposite polarity defining a gap of substantially constant width, the length of which extends along said section for concentrating magnetic lines of flux near the gap and rapidly decreasing the intensity of flux with increasing distances away from the gap, and a housing having a surface adapted to support a said article as a said marker secured thereto moved along said surface, and having a plurality of recesses therein within each of which one of said permanent magnet assemblies is positioned such that a field of the same polarity, but of less intensity at said surface is produced by each of said assemblies successively positioned in recesses to one side of a first recess, whereby a said marker secured to an article moved along said surface from a location over said first recess toward locations over the remaining recesses is successively exposed to fields of the same polarity and progressively lower intensity, causing the magnetizable component of the marker to become magnetized.

2. An apparatus according to claim 1, wherein each said magnetic assembly comprises a said ferromagnetic material, having two substantially opposed major surfaces and which is substantially uniformly magnetized to present opposite magnetic polarities at said opposite major surfaces and a pair of pole pieces each of which is proximate to and extends over a major portion of one of said major surfaces and terminates proximate to the other pole piece to provide a said gap.

3. An apparatus according to claim 1, comprising three of said permanent magnet assemblies, each having substantially the same field intensity proximate the respective gaps and wherein each successive assembly within a respective recess to one side of said first recess is positioned further from said surface.

4. An apparatus according to claim 1, comprising three of said permanent magnet assemblies, each having a progressively weaker field intensity proximate the respective gaps and wherein each assembly is positioned within a recess the same distance from said surface.

5. An apparatus according to claim 1, comprising five of said permanent magnet assemblies, each being positioned within a respective recess such that a center-most assembly produces a highest field intensity at said surface and successive assemblies on either side of said center-most assembly produce progressively weaker field intensities, thereby allowing an article having a said marker secured thereto to be moved in either direction along said surface, traversing over said recesses and after passing over the center-most recess to thereafter be successively exposed to fields of the same polarity and progressively lower intensity.

* * * * *